United States Patent [19]

Mackson

[11] Patent Number: 4,577,950

[45] Date of Patent: Mar. 25, 1986

[54] COMPUTER CONTROLLED REPLENISHING SYSTEM FOR AUTOMATIC FILM PROCESSOR

[76] Inventor: Richard G. Mackson, 2239 - 26th St., Santa Monica, Calif. 90405

[21] Appl. No.: 630,825

[22] Filed: Jul. 13, 1984

[51] Int. Cl.[4] ..... G03D 3/06

[52] U.S. Cl. ..... 354/324; 354/297

[58] Field of Search ..... 354/297, 298, 324

[56] References Cited

U.S. PATENT DOCUMENTS 4,314,753 2/1982 Kaufmann ..... 354/298

4,329,042 5/1982 Libicky et al. ..... 354/324

4,402,590 9/1983 Rubin ..... 354/324

4,486,082 12/1984 Wagner et al. ..... 354/324

*Primary Examiner*—A. A. Mathews

*Attorney, Agent, or Firm*—Keith D. Beecher

[57] ABSTRACT

A system for replenishing the chemical compounds of the various solutions used in an automatic film processor by which predetermined quantities of replenishing compounds are added to the tanks of the film processor during each operating cycle of the film processor, the quantities of the added replenishing compounds being automatically controlled by a computer in accordance with the quantity of film being processed at any particular time by the processor.

5 Claims, 2 Drawing Figures

COMPUTER CONTROLLED REPLENISHING SYSTEM FOR AUTOMATIC FILM PROCESSOR

BACKGROUND OF THE INVENTION

The use of automatic film processors is well established in the prior art. One such automatic film processor for example, is described and claimed in Copending application Ser. No. 630,634 filed July 13, 1984 in the name of the present inventor. As is well known in automatic film processors, the developer and other solutions are subject to change as film is developed. For example, in the course of the operation silver halide is reduced in the developer solution to metallic silver, whereby a reducing agent contained in the developer is consumed and a concentration of free halide in the developer solution occurs. For the continuous development of a series of film it is necessary to add to the developer a quantity of replenisher which corresponds to the actual consumption of the developer, to neutralize inhibiting by-products, and to drain away the used solution. In like manner, the various solutions used in the other tanks of the automatic film processor, such as the reversal tank, color developer tank, conditioner tank, bleach tank, and fixer tank must also be replenished from time-to-time.

Automatic equipment has been used in the past either to monitor and analyze the chemical constituents of the processing solutions, or to read the density of processed film strips, and to use the resulting data to control the replenishment of the various solutions in the film processor.

However, the prior art automatic equipment has proven to be unduly complex and expensive. The primary object of the present invention is to provide automatic equipment for replenishing the various solutions in an automatic film processsor without any need for the automatic equipment to analyze the processing solutions, or for the automatic equipment to read the density of processed film strips.

In accordance with the teaching of the present invention, the amount of concentrates consumed by various sizes of rolls of films, and various sizes of film sheets, on a square footage basis, is pre-calculated and stored in a computer memory. Then, prior to the processing of any particular film on any rack of the automatic film processor, data concerning the number and sizes of the rolls and/or sheets is fed into the computer, and the computer algorithm responds to the input data to cause appropriate control pumps to be turned on for computed times while the rack is placed successively in the tanks of the processor, so that the various solutions in the tank are replenished during the processing of the film, with amounts of replenishing solutions depending upon the total square footage of film on each rack.

Accordingly, the system of the present invention is simple and straightforward in that the automatic processing equipment itself does not monitor the various solutions in the tanks of the film actually being processed. Instead, and as described briefly above, a predetermined amount of replenishing solution is introduced into each tank of the automatic film processor as a rack of film is positioned in that tank, and the amount of replenishing solution introduced to each tank is determined by the square footage of film carried by that rack.

Briefly stated, in the system of the invention data is inputed to the computer designating the number and sizes of rolls or sheets of film next to be processed by the processor on each rack, and the computer is programmed to activate appropriate metering means so that the exact quantity of replenishment solution required in each tank of the processor for each rack of film to be processed may be supplied while the film is being processed.

The same computer may be used to control the automatic film processor itself, in the manner described in the Copending Application. The computer responds to the same input data fed into it for the replenishment control to provide appropriate controls for the film processsor itself.

DETAILED DESCRIPTION OF THE ILLUSTRATED EMBODIMENT

Figure 1:
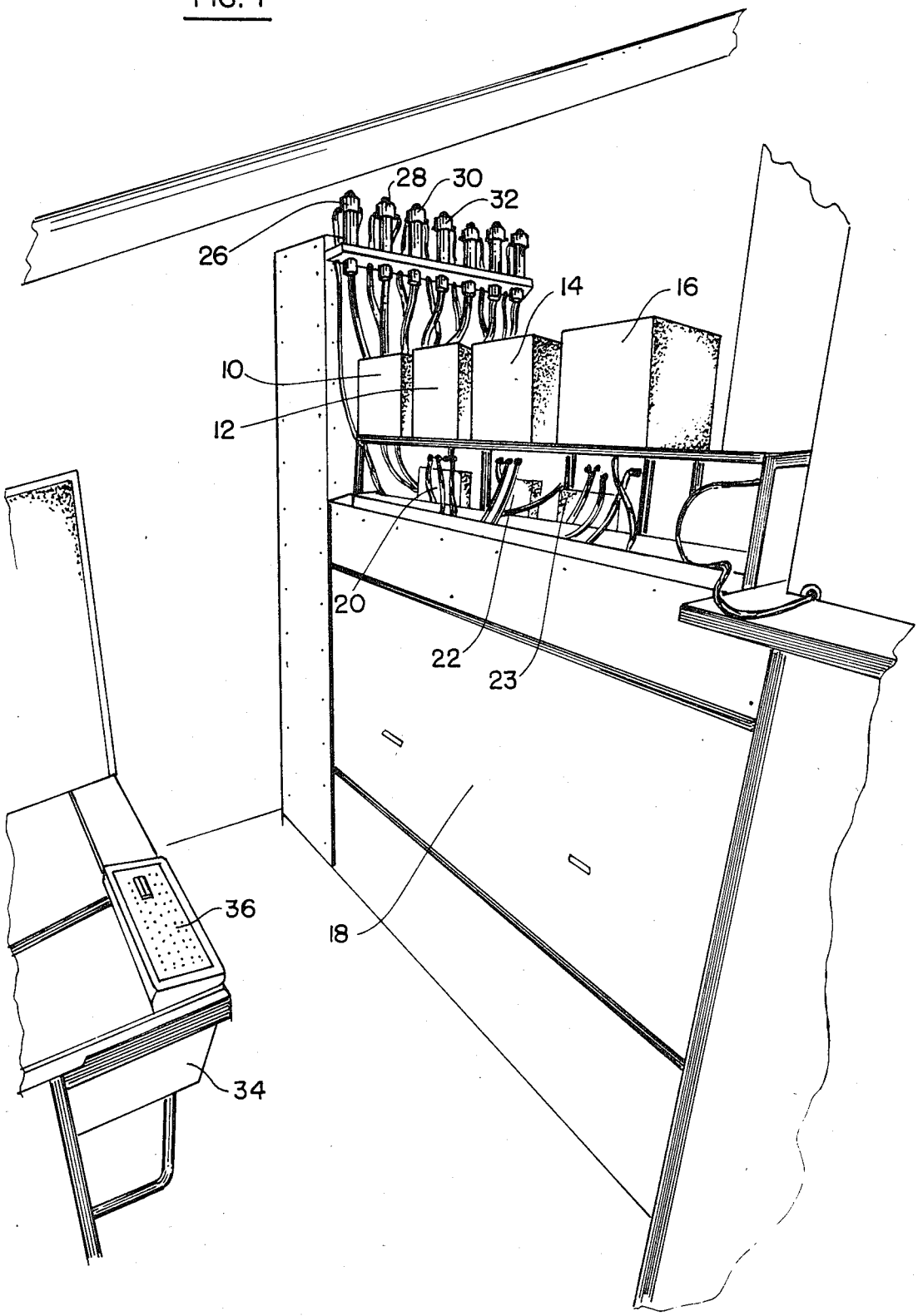
FIG. 1 is a perspective representation of a computer controlled replenishing system for an automatic film processor representative of one embodiment of the invention.

The replenishing system of FIG. 1 includes a number of reservoirs 10, 12, 14 and 16 which contain stock concentrates for replenishing the various solutions contained in the associated automatic film processor which is contained, for example, in a housing 18. Each of the reservoirs has a motor driven pump, such as pumps 20, 22, 23 associated therewith, and these pumps are controlled by pump concentrate from the various reservoirs into respective mixing vessels, such as gravity mixing vessels 26, 28, 30 and 32.

The mixing vessels are coupled to appropriate water reservoirs, as will be described, and serve to mix the concentrates pumped out of the various reservoirs 10, 12, 14 and 16 with predetermined amounts of water, so that appropriate concentrate replenishing solutions may be fed by gravity to the various tanks of the film processor contained within housing 18. The operations are controlled by a computer 34 having a keyboard 36 connected to it.

Figure 2:
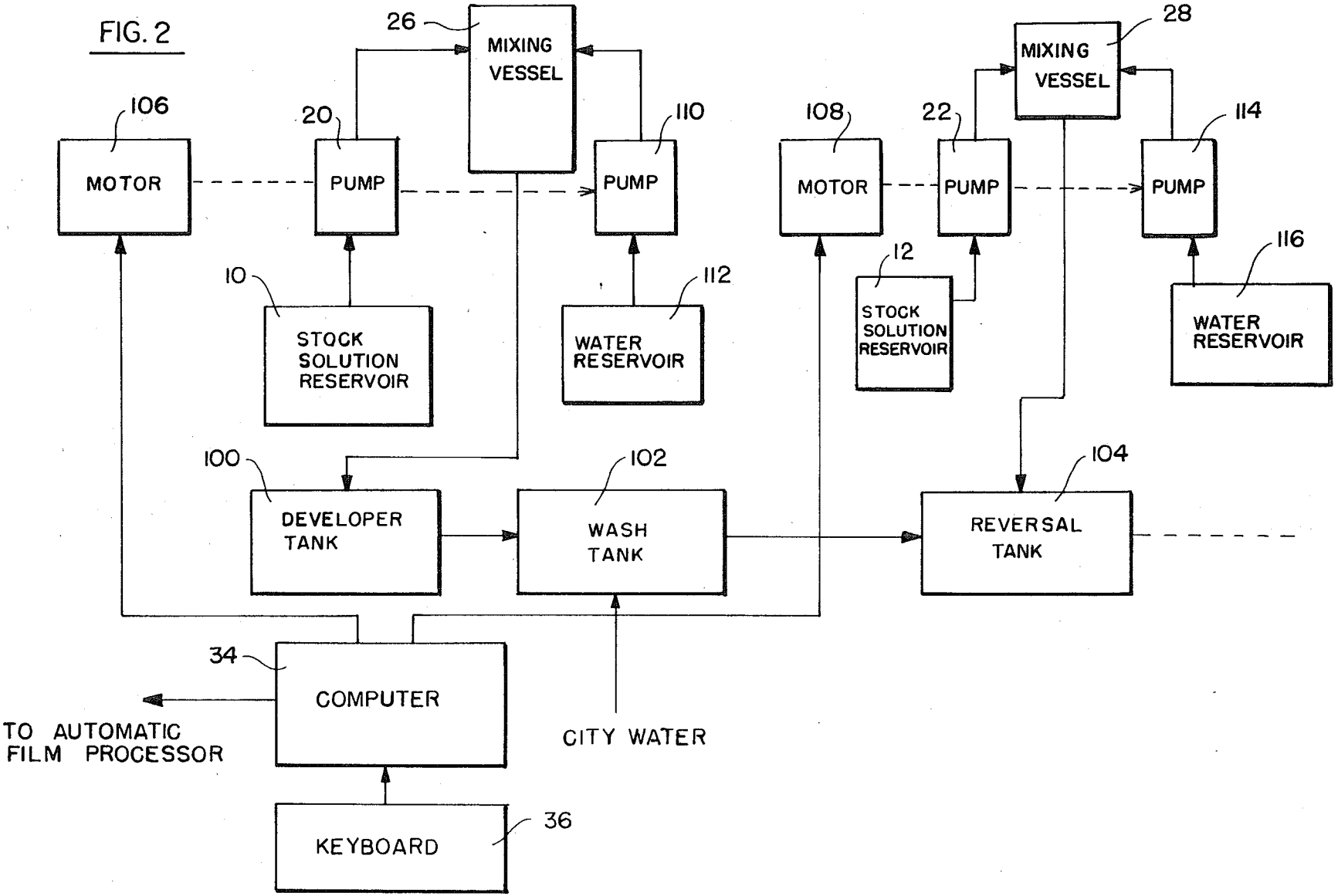
FIG. 2 is a block diagram of a portion of the system of FIG. 1.

As shown the block diagram of FIG. 2, the automatic film processor includes a series of tanks such as a developer tank 100, a wash tank 102, a reversal tank 104 and a number of additional tanks (not shown). During the processing of film by the automatic film processor, the film is automatically inserted in a successive manner into the developer tank 100, then into the wash tank 102, then into the reversal tank 104, and so on.

Two of the reservoirs 10 and 12 are shown in the block diagram of FIG. 2, and the replenishment concentrates from these two reservoirs are pumped to mixing vessels 26 and 28 by respective pumps 20 and 22. The pumps 20 and 22 are driven by motors 106 and 108 which, in turn, are controlled by the computer 34. Motor 106 also drives a pump 110 which pumps water from an appropriate water reservoir 112 into the mixing vessel 26, so that the concentrate from the stock solution reservoir 10 may be mixed with a predetermined amount of water to form a desired solution of a predetermined concentration which is fed by gravity to the developer tank 100.

Likewise, motor 108 also drives a pump 114 which pumps water from a reservoir 116 to mixing vessel 28, so that a concentrate solution of predetermined concentration may be fed by gravity to the reversal tank 104.

In like manner, similar metering equipment as shown in FIG. 2 is associated with the other tanks of the automatic film processing apparatus, so that each tank may be appropriately replenished by a solution of its stock concentrate.

Pumps 20, 22, 110 and 114 may be appropriate metering pumps, for example, of the bellows type such as are presently marketed by the Waltham Chemical Pump Corporation of Waltham, Mass. and designated by them as as "The Walchem Bellows Pump".

Prior to the processing of any particular batch of photographic film, the size and number of film rolls or sheets to be processed on any particular rack is keyed into computer 34 by keyboard 36. The keyboard is programmed to respond to the data to turn on motors 106 and 108 for computed time intervals, so that the various tanks of the automatic film processor may by appropriately replenished by the exact amount of concentrate consumed during the immersion of the film into each tank. During the replenishment, the spent compounds in the various tanks are caused to overflow and drain.

The automatic replenishing system of the invention is extremely accurate and precise, because the precise amounts of concentrates to be consumed by any particular film may be accurately calculated on the basis of the square footage of the film. The system of the invention is simple in its concept, since there is no need for any complex means within the system for monitoring either the chemicals in the tanks, or for sensing developed film strips. The system is also simple to operate.

It will be appreciated that while a particular embodiment of the invention has been shown and described, modifications may be made. It is intended in the claims to cover all modifications which come within the true spirit and scope of the invention.

What is claimed is:

1. A system for controlling replenishment solution to a photographic film processor, said system comprising: a reservoir containing a solution concentrate; metering means coupled to the reservoir for transferring a metered quantity of the concentrate from the reservoir to the processor as a replenishment solution; computer means electrically connected to said metering means for activating said metering means for a time interval computed by said computer means, said computer means including a memory in which data representing pre-calculated amounts of concentrate consumed by various sizes of films is stored; and input means including a manually operated keyboard connected to said computer means for inputing data to said computer means concerning the size of the next film to be processed by the film processor so as to enable said computer means to compute the correct time interval required for the metering means to transfer the correct replenishing amount of said concentrate to the processor for the next film to be processed, and to activate said metering means for said correct time interval.

2. The system defined in claim 1, in which said metering means comprises a pump and an electric drive motor mechanically coupled to the pump and activated by said computer means.

3. The system defined in claim 2, in which said metering means further includes a mixing vessel coupled to the outlet of the pump and interposed between the pump and the processor.

4. The system defined in claim 3, and which includes a second pump coupled to a water source and having its outlet coupled to the mixing vessel, said second pump being driven by said motor to cause the concentrate from said reservoir to be mixed with water in a predetermined proportion prior to being introduced to the processor.

5. The system defined in claim 1, in which said computer means is also electrically connected to the film processor to control the operation thereof in accordance with said data fed into the computer means by said input means prior to the processing on any particular film by said processor.

* * * * *